US007625247B1

(12) United States Patent
Mahoney et al.

(10) Patent No.: US 7,625,247 B1
(45) Date of Patent: Dec. 1, 2009

(54) SELF-CONTAINED INTERNAL CONNECTOR SEIZURE MECHANISM

(75) Inventors: William G. Mahoney, Suwanee, GA (US); Robert R. Riggsby, Sandy Springs, GA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 12/169,938

(22) Filed: Jul. 9, 2008

(51) Int. Cl.
*H01R 13/24* (2006.01)

(52) U.S. Cl. ..... 439/700; 439/63

(58) Field of Classification Search ..... 439/578, 439/583, 700, 63

See application file for complete search history.

(56) References Cited

U.S. PATENT DOCUMENTS

| | | | |
|---|---|---|---|
| 6,811,447 | B2 | 11/2004 | Pfister et al. |
| 7,318,756 | B2 | 1/2008 | Mahoney et al. |
| 2005/0085135 | A1 | 4/2005 | Pfister et al. |
| 2006/0196048 | A1 | 9/2006 | Pfister et al. |

*Primary Examiner*—Briggitte R Hammond
(74) *Attorney, Agent, or Firm*—Lewinski Law Group LLC

(57) ABSTRACT

In one embodiment a self-contained seizure mechanism comprises a plunger, a spring, and a retainer guide having means for movably securing the plunger to the retainer guide. The retainer guide may have a receiving slot for receiving wings of the plunger and fingers for retaining the wings to the retainer guide and archways to guide a stinger conductor into contact with a crown of the plunger. The plunger and retainer may be snap-fit together to provide a seizure assembly that may be dropped in a receiving hole of a node housing and positioned to engage a stinger conductor and urge the stinger conductor into contact with a connector button on a lock nut.

18 Claims, 8 Drawing Sheets

SELF-CONTAINED INTERNAL CONNECTOR SEIZURE MECHANISM

TECHNICAL FIELD

The present disclosure relates generally to connections for communications networks having radio frequency (RF) amplifiers, and more particularly, to connections at network nodes.

BACKGROUND

Community Antenna Television (CATV) has traditionally relied on metallic coaxial cabling to deliver video signals. The conductors that transport RF signals through CATV networks may be connected at various points within the network, such as head ends, central offices, nodes, and distribution and subscriber premises equipment devices. Electrical devices at the network nodes may be located outdoors and may be aerially hung from a conductor strand or positioned on a pedestal or in a cabinet on the ground. Coax conductors are typically connected to equipment by connectors that match the conductor impedance and are designed to minimize signal loss.

A stinger is a device known in the art for providing an RF connection. A stinger may comprise a hollow metallic shell threaded on the outside, a center conductor and a dielectric interposed between the conductor and the inner surface of the shell. The stinger is typically threaded into a penetration into a node housing so that when the stinger is installed it is in a predetermined position. The center conductor projects axially from the stinger such that the device resembles a bee stinger, hence the name. The stinger conductor may be guided by a guide device in the housing that may include a narrow channel to guide the conductor, such that the nail head of a threaded seizure connector device may contact the center conductor when the seizure connector is perpendicular to the stinger conductor. A seizure assembly may be used to connect a stinger conductor to a nail head. Scientific-Atlanta's U.S. Pat. No. 6,811,447, which is incorporated herein by reference, discloses an external seizure assembly which is accessed from the exterior of a node housing. Scientific-Atlanta's U.S. Pat. No. 7,318,756, which is incorporated herein by reference, discloses an internal seizure assembly for providing connectivity with a conductor of a stinger in which a plunger is inserted through a retainer threadably installed in the interior of the node housing and adjusted to a desired depth to ensure a proper connection.

DESCRIPTION OF EXAMPLE EMBODIMENTS

Overview

Figure 1:
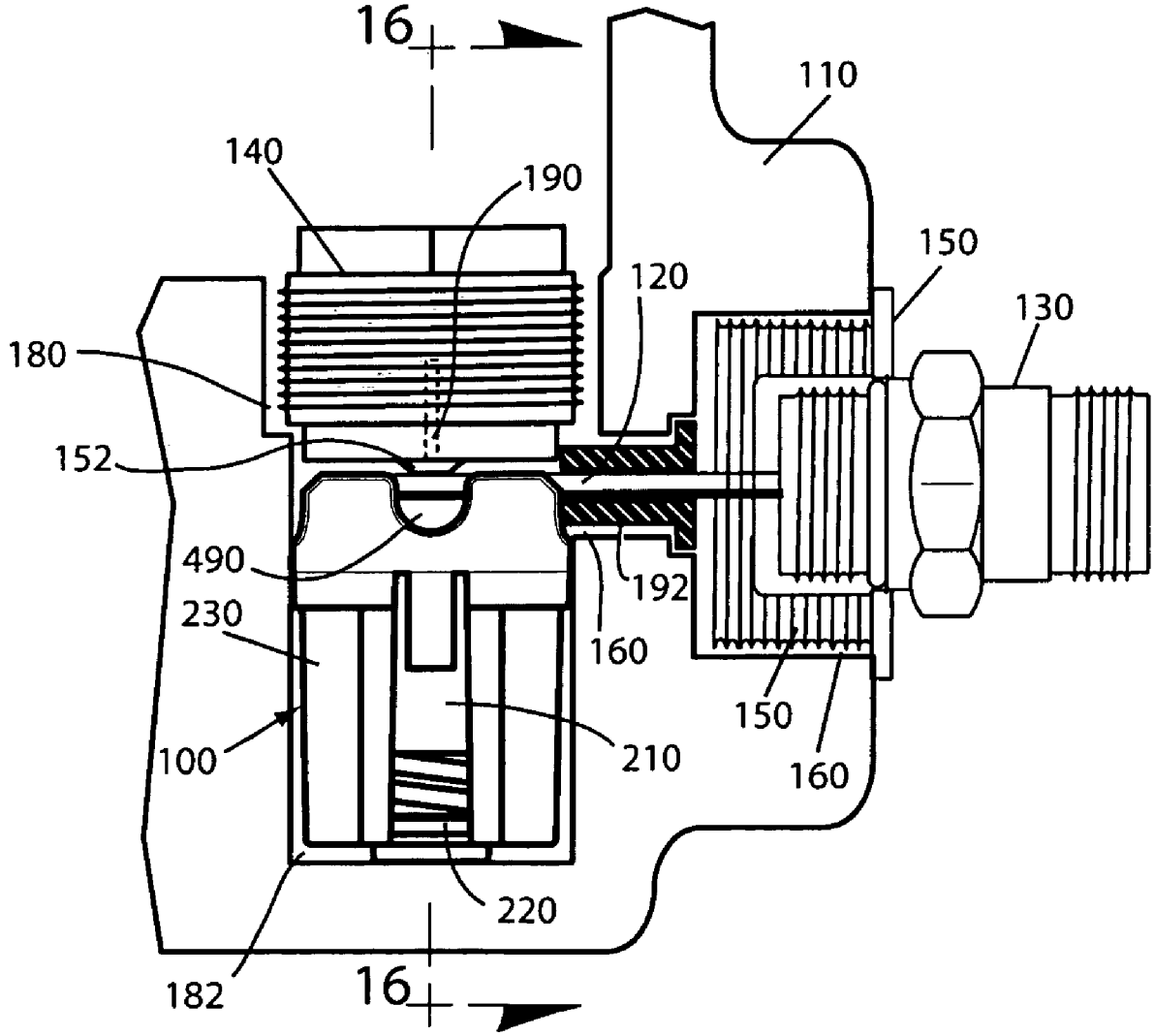
FIG. 1 illustrates an example internal seizure mechanism installed in a node housing for establishing electrical connection with a stinger conductor.

A self-contained internal connector seizure mechanism for an RF node connector may be in the form of a self-contained seizure assembly that is configured for installation in the interior of a node housing. In an example embodiment, the seizure assembly comprises a plunger for contacting and urging a stinger conductor into contact with a conductor button of a lock nut, a retainer guide for receiving and movably retaining the plunger therein and guiding the stinger conductor into contact with the plunger, and a spring for urging the plunger into contact with the stinger conductor. The plunger, spring, and retainer guide may be configured for assembly together into a self-contained mechanism that is self-orienting and self-guiding. The seizure mechanism may be installed in a node housing by simply dropping it into a receiving hole and would automatically be positioned for engagement with a stinger center conductor installed within a penetration of the node housing. The seizure mechanism may urge the stinger conductor into contact with a conductor button on a seizure lock nut to establish an electrical connection. In an example embodiment, the internal seizure mechanism may be snap-fit together to allow a technician in the field to easily and quickly install the assembly without the need of adjusting the orientation or height of the mechanism.

In an example embodiment, the retainer guide may comprise a hollow, generally cylindrical housing having opposed open and closed ends, the open end serving as a mouth leading to an inner plunger-receiving area adapted to receive a plunger therein. The open end may include archways provided in the ends of the sidewalls that serve as guide ways for receiving a stinger conductor that is inserted in a penetration of the node housing. The closed end may be obround or otherwise shaped to key to a receiving hole in the node housing to ensure the mechanism is in a desired orientation.

The plunger may include a hollow generally cylindrically-shaped body having opposing closed and open ends, the body being adapted for insertion into the mouth and plunger-receiving area of the retainer guide. The plunger may have an interior spring-receiving space for receiving and holding a spring and a crown at the closed end that is adapted for engagement with a stinger conductor. The crown may have ramps that extend upward to a contact portion and legs that extend upward from a periphery of the closed end. The legs may be adapted to engage a seizure locknut installed in the node housing opposite the seizure mechanism that includes a conductor button and a center pin conductor.

The spring may be inserted into the spring-receiving space of the plunger and the plunger and spring inserted through the mouth of the retainer guide so that one end of the spring abuts the closed end of the retainer guide and the other end of the spring abuts the closed end of the plunger so that the spring pushes the crowned end of the plunger in an outward toward the open mouth of the retainer guide.

Retaining means may be provided to movably secure the plunger to the retainer guide and prevent the plunger from being expelled from the retainer guide. In an example embodiment, the plunger may be provided with outwardly extending wings that mate with receiving slots provided in sidewalls of the retainer guide to movably secure the plunger to the retainer guide. The position and orientation of the plunger within the retainer guide can be tightly controlled by a snap-fit arrangement to ensure the proper positioning of the mechanism relative to a penetration in the node housing so that the mechanism engages a stinger conductor installed in the penetration. This eliminates the need of threadably installing the seizure mechanism and adjusting the height or orientation of the mechanism for proper installation in the node housing. The spring, plunger and retainer guide may be arranged so that under an applied force the stinger conductor contacts the contact button of the seizure lock nut.

The present invention will be described more fully hereinafter with reference to the accompanying drawings in which like numerals represent like elements throughout the several figures that depict example embodiments of the invention is shown. The invention may, however, be embodied in many different forms and should not be construed as being limited to the example embodiments set forth herein. Rather, the embodiments are provided so that this disclosure will be thorough and complete, and will fully convey the scope of the invention to those skilled in the art.

Turning now to the figures, FIG. 1 shows an example embodiment of a self-contained internal seizure mechanism 100 installed in a node housing 110. The seizure mechanism 100 establishes an electrical connection between a stinger conductor 120 of a stinger 130 and the center pin 190 of a seizure lock nut 140. The seizure mechanism 100 contacts and exerts a force on the stinger conductor 120 to provide a mechanical and electrical connection between the stinger conductor 120 and a conductor button 152 electrically connected to the center pin 190 to provide connectivity to the external co-axial hard line cable via the stinger center conductor 120. In the example embodiment of FIG. 1, the stinger 130 is screwed into a bushing 150 which is itself threaded into a penetration 160 in the housing 110.

Figures 2, 3:
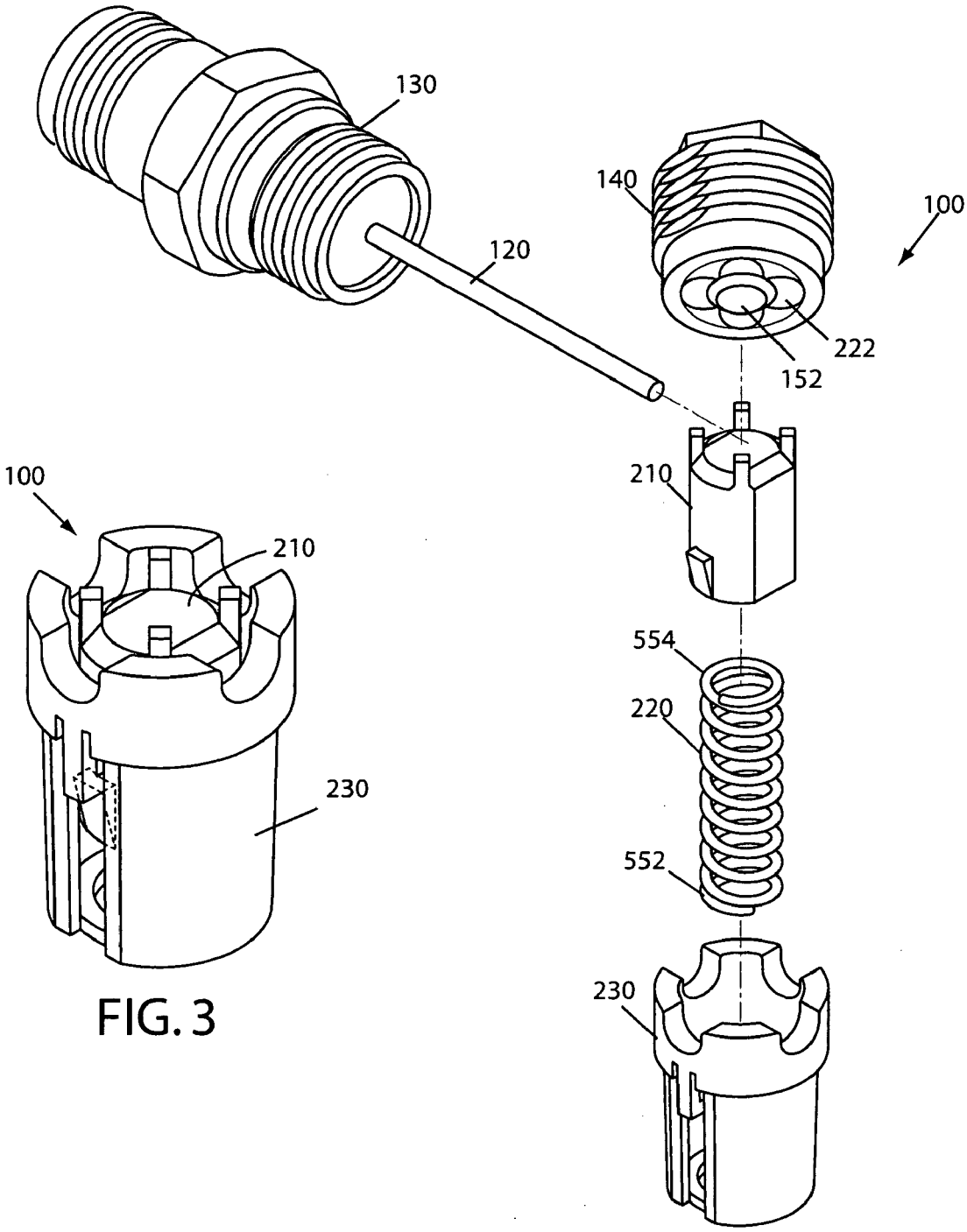
FIG. 2 illustrates an exploded view of an example self-contained internal seizure mechanism.
FIG. 3 illustrates an example internal seizure assembly.
Figure 5:
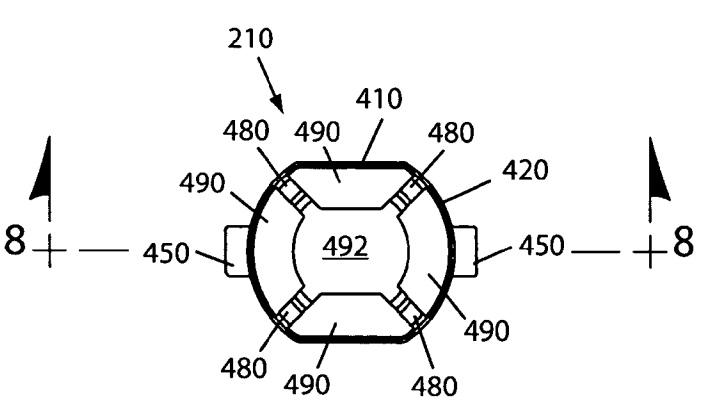
FIG. 5 illustrates a top view of the plunger of FIG. 4.
Figure 4:
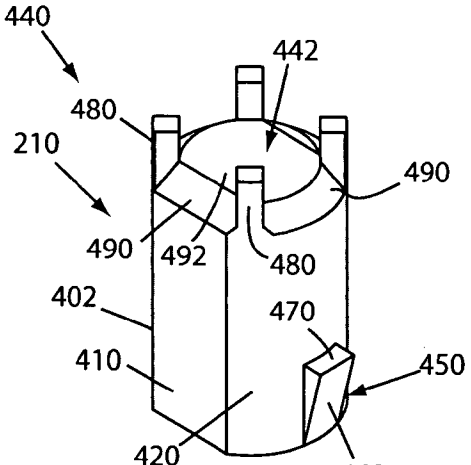
FIG. 4 illustrates a perspective view of an example of a plunger for use with a self-contained seizure mechanism.
Figure 8:
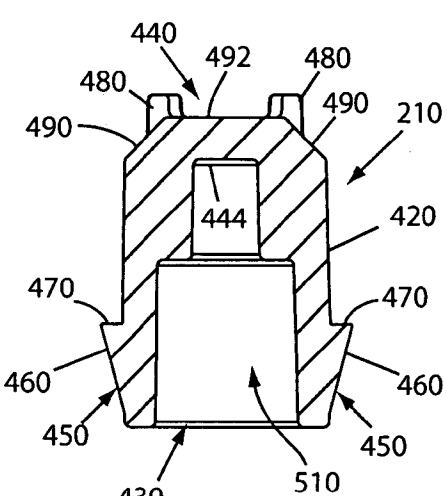
FIG. 8 illustrates a cutaway view of the plunger of FIG. 4 along cut line 8-8 of FIG. 4.
Figure 7:
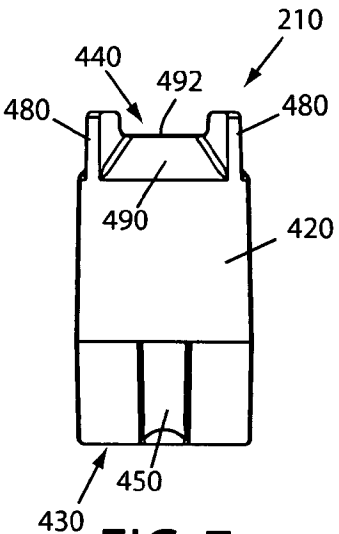
FIG. 7 illustrates a side view of the plunger of FIG. 4.
Figure 6:
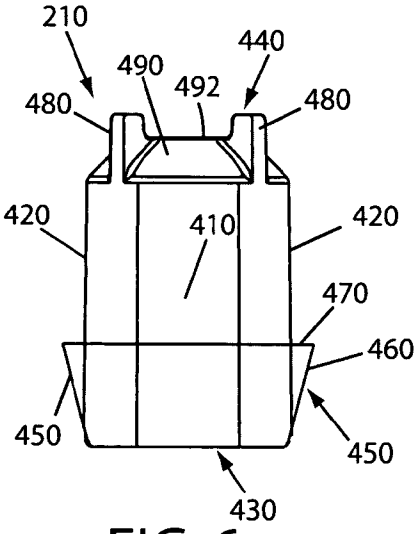
FIG. 6 illustrates a front view of the plunger of FIG. 4.
Figure 9:
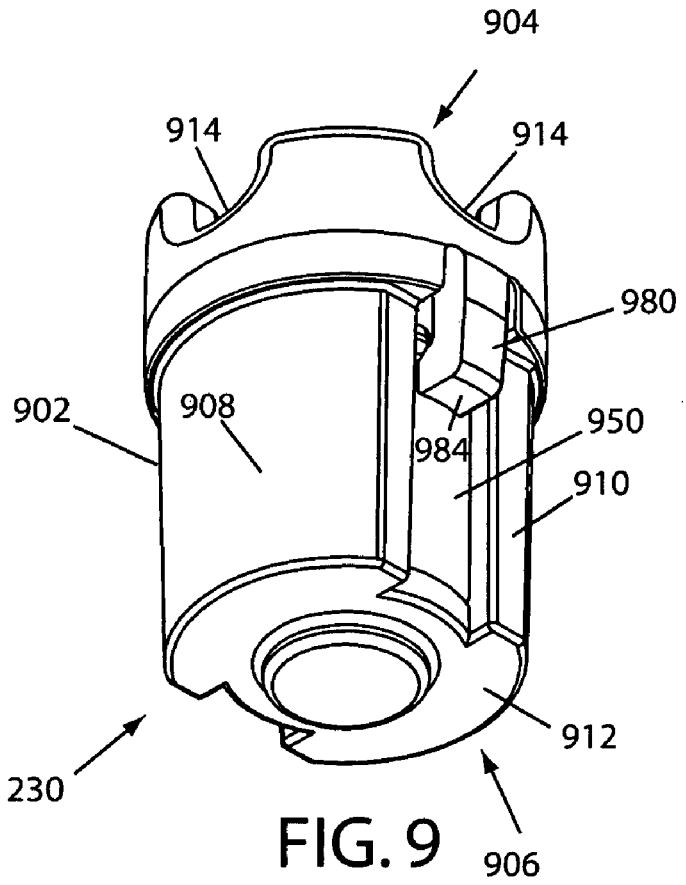
FIG. 9 illustrates a perspective view of an example of a retainer guide for use with a self-contained internal seizure mechanism.
Figure 10:
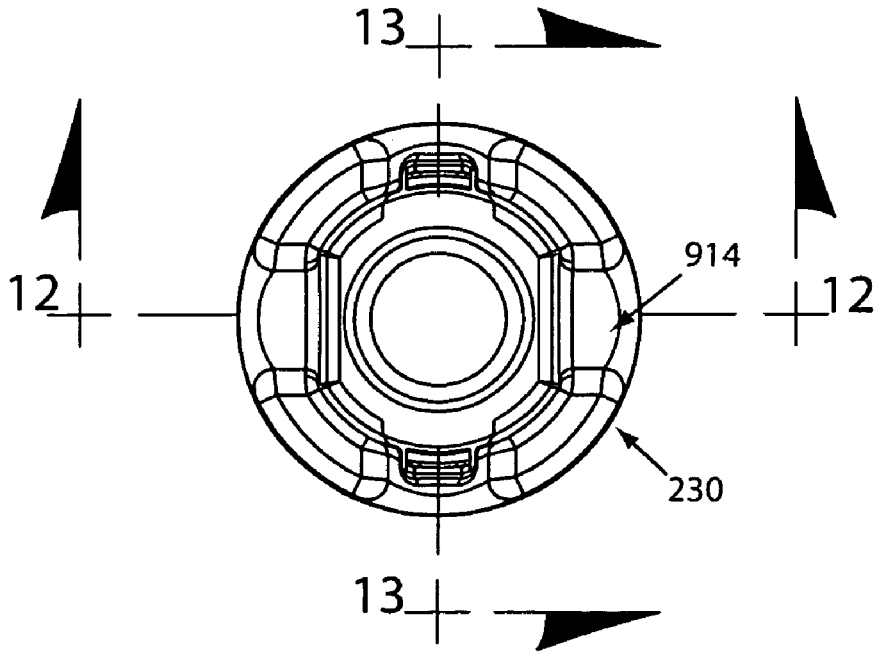
FIG. 10 illustrates a top view of the retainer guide of FIG. 9.
Figure 11:
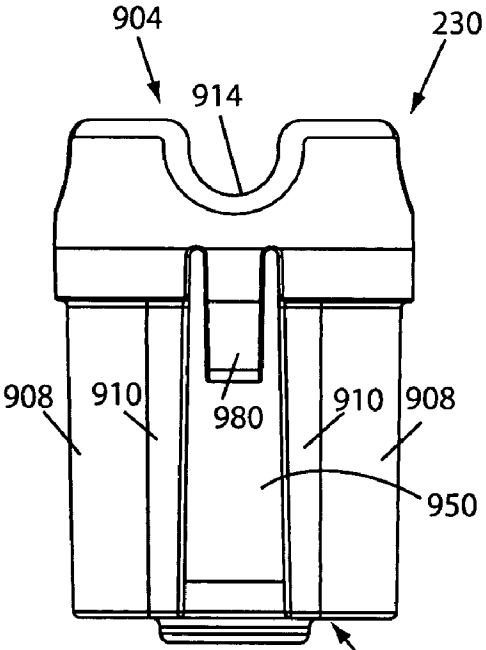
FIG. 11 illustrates a side view of the retainer guide of FIG. 9.

FIG. 2 shows an exploded view of an example embodiment of the internal seizure mechanism 100 that comprises a plunger 210, a spring 220, and a retainer guide 230 which may be assembled together to provide the self-contained internal seizure mechanism 100 as shown in FIG. 3. When assembled, the seizure mechanism 100 has a longitudinal axis defined by the axis of compression of the spring 220. The plunger 210 interacts with the retainer guide 230 so as to be movably retained in the retainer guide 230 with the spring 220 in an initial compressed condition.

Figure 12:
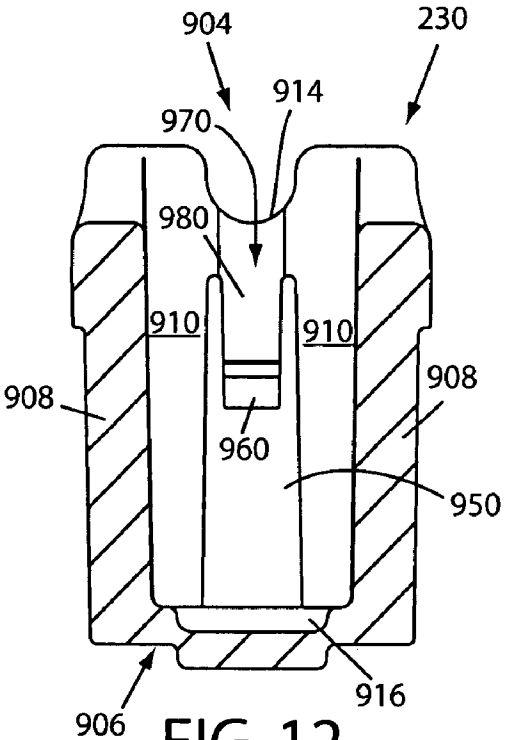
FIG. 12 illustrates a cutaway view of the retainer guide of FIG. 9 along cut line 12-12.
Figure 13:
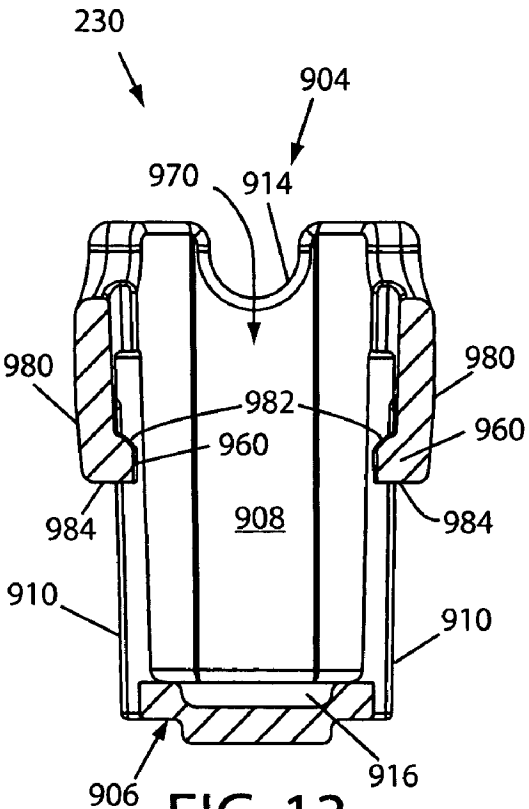
FIG. 13 illustrates a cutaway view of the retainer guide of FIG. 9 along cut line 13-13.

In the example embodiment shown in FIGS. 4-8, the plunger 210 has a hollow, generally cylindrically-shaped body 402 comprising curved sidewalls 420 disposed between outer generally flat sidewalls 410. The sidewalls 410, 420 extend between an open first end 430 and a closed second end 440 having end wall 444. The sidewalls 410, 420 and end wall 444 define an interior spring-receiving area 510 adapted to receive and hold a spring 220 therein. The plunger 210 is shaped to conform to a plunger-receiving area 970 (FIG. 12) within the retainer guide 230 so that the plunger 210 may be inserted into the retainer guide 230.

A mating element may be provided on the plunger 210 for interacting with the retainer guide 230 to movably secure the plunger 210 to the retainer guide 230. In an example embodiment, a pair of wings 450 protrudes outwardly from the curved sidewalls 420 of the plunger 210 near the open end 430. The wings 450 may include angled surfaces 460 that act as ramps for engaging a portion of a retaining means of the retainer guide 230, and a generally horizontal abutting surface 470 for engaging the retainer guide 230 as discussed in more detail below. The conforming shapes of the plunger 210 and retainer guide 230, along with the engagement of the wings 450 with the retainer guide 230, ensure the proper positioning of the plunger 210 within the retainer guide 230. The mechanism 100 is installed in a node housing 110. The plunger 210 may be made of non-conductive material, such as a polymer such as polyoxymethylene plastic sold under the tradename Delrin® by DuPont which has a desirable dielectric constant value and desired effect on RF performance.

The closed end 440 of the plunger 210 may form a crown 442 that includes a plurality of vertically extending legs 480 positioned along the periphery of the closed end 440. A plurality of sloping end walls 490 may be provided between the legs 480 that gradually extend upward between adjacent pairs of legs 480 to a generally planar contact portion 492. The sloped walls 490 between adjacent legs 480 may serve as ramps for guiding the distal end of a stinger center conductor 120 when the stinger 130 is installed in the node housing 110. The stinger conductor 120 contacts the crown 442 of the plunger 210, between the legs 480, and is guided up one of the ramps 490 to the apex of the plunger contact portion 492.

The legs 480 and ramps 490 help keep the stinger center conductor 120 centered on top of the plunger contact portion 492. The plunger 210 can be keyed to the interior of the retainer guide 230. The closed end 1030 of the retainer guide 230 in turn may be keyed to a bottom 182 of an opening 180 of the node housing 110. Accordingly, the legs 480 may be oriented so as to not obstruct the distal end of the stinger center conductor 120 as it is passed into the interior of the node housing 110 through the penetration 160, as discussed in more detail below.

As shown in FIGS. 9-13, an example embodiment of a retainer guide 230 may include a hollow body 902 having an open end 904 and a closed end 906 having an end wall 912. Curved sidewalls 908 positioned between opposing generally planar sidewalls 910 may extend between the open 904 and closed 906 ends to define an interior plunger-receiving area 970 for movably receiving the plunger 210. A plurality of guide ways in the form archways 914 may be provided at the top ends of the sidewalls 908, 910 to guide a stinger conductor 120 into contact with the crown 442 of the plunger 210 when the seizure mechanism 100 is installed in a node housing 110. As shown in FIG. 3 when the seizure mechanism 100 is assembled, the crown 442 of the plunger 210 is positioned within the retainer guide 230 so that a ramp 490 of the plunger 210 is accessible through the archway 914.

A recess 916 may be provided near the closed end 906 of the retainer guide 230 to receive a bottom end 552 of a spring 220 when the plunger 210 is inserted into the retainer guide 230. The closed end 906 of the retainer guide 230 may be configured to key to a bottom 182 of a receiving hole 180 in the node housing 110 so that an assembled seizure mechanism 100 can be dropped into the node opening 180 and be self-orienting and self-leveling and provide a fixed stopping point.

The retainer guide 230 may also include retaining means to retain the plunger 210. In the example embodiment shown in FIG. 9, receiving slots 950 provided within the opposing sidewalls 910 of the retainer guide 230 may be configured to receive and mate with the wings 450 of the plunger 210 so that the plunger 210 may be coupled to the retainer guide 230 such that it is moveable along the longitudinal axis of the retainer guide 230. Retaining fingers 980 may be provided that extend within the receiving slots 950. A tab 960 may be provided at the end of each retaining finger 980 and protrude partially into the plunger-receiving area 970 of the retainer guide 230. The plunger body 402 may be shaped to conform to the plunger-receiving area 970 so that the wings 450 of the plunger 210 align with the receiving slots 950 of the retainer guide 230. For example, the plunger-receiving area 970 and the plunger body 402 may be obround. The retaining fingers 980 may be made of a slightly flexible plastic, such as Delrin®, to allow the fingers 980 to flex outward from an initial position to allow insertion of the plunger wings 450 into the receiving slots 950 when the plunger 210 is inserted into the retainer guide 230. The retaining fingers 980 may then return to their initial position once the plunger 210 has been sufficiently inserted that the wings 450 move past the fingers 980. To assist in the mating of the plunger 210 with the retainer guide 230, the tabs 960 may have an angled portion 982 to engage the angled face 460 of the plunger wings 450 and allow the wings 450 to slide past the tabs 960. The tabs 960 may also include generally horizontal abutting portions 984 that abut the abutting surface 470 of the wings 450 after the wings 450 move past the tabs 960, thereby retaining the plunger 210 within the retainer guide 230 and limiting the movement of the plunger 210 outward of the retainer guide 230 by the force of the spring 220.

As seen in FIG. 3, when the seizure mechanism 100 is assembled, the plunger 210 and retainer guide 230 are held together so that the spring 220 is in a slightly compressed state and abuts the plunger end wall 444 and the guide end wall 912. The crown 442 of the plunger extends toward the mouth 904 of the guide with the legs 480 generally flush with the top end of the retainer guide 230. In this condition, the spring 220 exerts a force on the plunger 210 to push the plunger 210 in a direction outward from the retainer guide 230. The spring 220 may be selected having a desired deflection, or spring constant, so as to exert a desired force on the plunger 210. In turn, a desired force is applied against the stinger conductor 120 when the stinger 130 is installed in the node housing 110 to provide a desired connection between the stinger conductor and a conductor button 152 without damaging the stinger conductor.

Figure 14A:
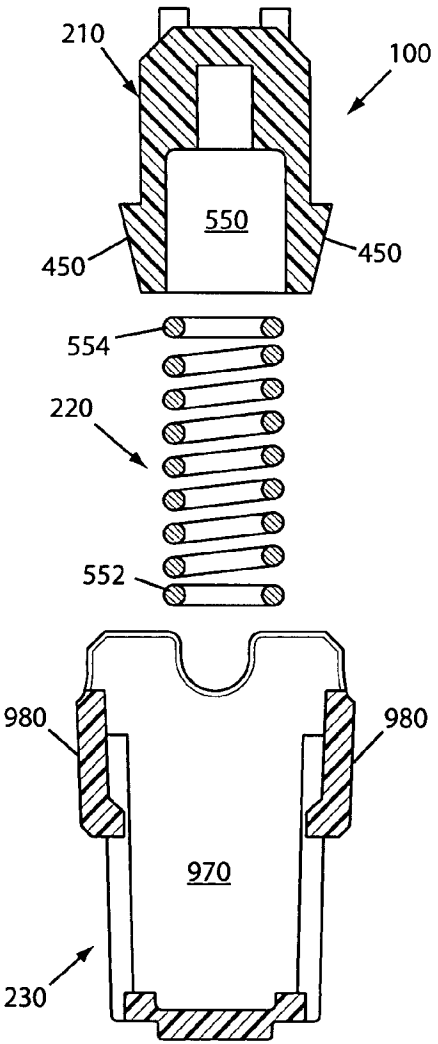
FIGS. 14A-14E illustrate the assembly of an example self-contained internal seizure mechanism.
Figure 14B:
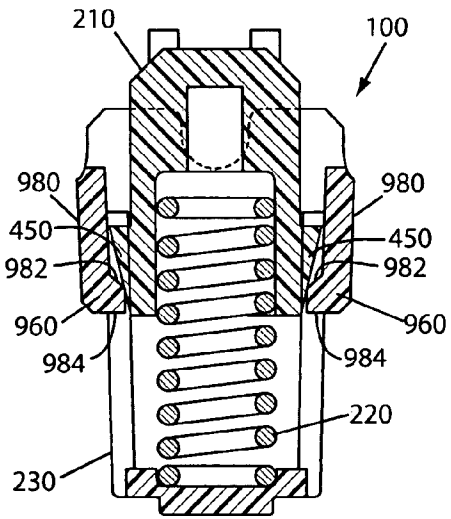

FIGS. 14A-14E illustrate an example method of how a plunger 210, spring 220, and retainer guide 230 may be snap-fit together to form a self-contained seizure mechanism that is self-guiding and self-orienting. As discussed above, the retainer guide 230 may have an interior plunger-receiving area 970 adapted to receive and movably retain the plunger 210, and the plunger 210 may in turn have an interior spring-receiving area 550 adapted to receive and retain the spring 220. The spring 220 is shown as a helical metal coil spring, but other springs or resilient means could be used. The spring 220 may be placed in the plunger 210 as shown in FIGS. 14A-B so as to abut the end wall 444 of the plunger's crown 442. The plunger 210 and spring 220 may then be inserted through the mouth 904 of the retainer guide into the plunger-receiving area 970, so that the spring 220 is received in the spring-receiving recess 972 of the retainer guide 230. As mentioned above, the plunger 210 is shaped to conform to the interior of the retainer guide 230 so that the plunger 210 is placed in a desired orientation within the retainer guide 230 with the wings 450 of the plunger 210 aligned with the receiving slots 950 of the retainer guide 230.

Figure 14C:
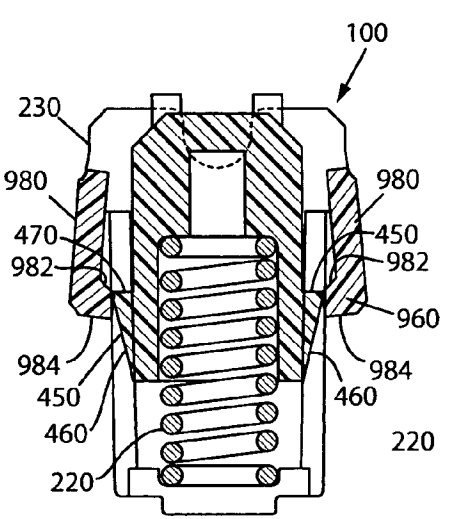
Figure 14D:
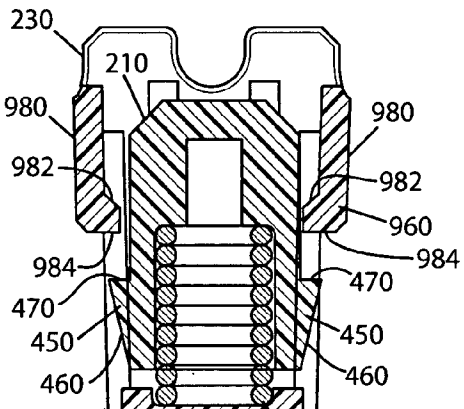
Figure 14E:
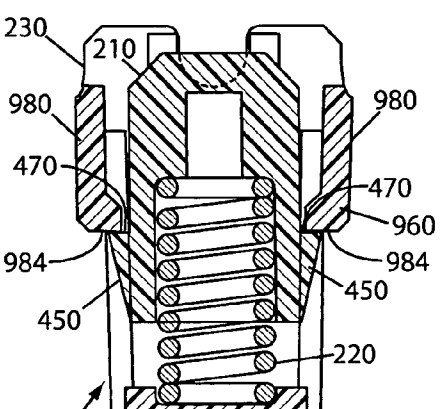

When the plunger 210 is inserted into the retainer guide 230, the wings 450 of the plunger 210 enter the top end of the retaining slots 950 of the retainer guide 230, as seen in FIGS. 14A-B. Upon further insertion of the plunger 210, as shown in FIG. 14C, the wings 450 of the plunger 210 engage the tabs 960 of the retaining fingers 980 and force the retaining fingers 980 outward. The bottom end 552 of the spring 220 abuts the bottom closed end wall 912 of the retainer guide 230 and a top end 554 of the spring 220 abuts the top closed end wall 444 of the plunger 210 so that the spring 220 is compressed by the downward movement of the plunger 210. The angled surfaces 460 of the plunger wings 450 may engage the angled portion 982 of the tabs 960 so that the wings 450 slide past the tabs 960 upon further insertion of the plunger 210. The insertion of the plunger 210 may stop once the wings 450 move beyond the tabs 960 and be released so that the retaining fingers 980 return to their initial unflexed position (FIG. 14D). Upon release of the plunger 210, the plunger 210 is forced back upward by the force of the compressed spring 210 against the plunger end wall 444. As seen in FIG. 14E, the plunger 210 is prevented from further upward movement by the abutment of the abutting face 470 of the plunger wing 450 against the abutting portion 984 of the retaining tabs 960. The spring 220 is held in the partially compressed state of FIG. 14E pushing against the closed end walls 444, 912 of the plunger 210 and retainer guide 230 so that plunger is provided at a desired position in the retainer guide 230. The plunger 210 can travel along the longitudinal axis of the plunger if a sufficient force is applied to push the plunger 210 further downward into the retainer guide 230 further compressing the spring 220.

The interlocking shapes of the plunger 210 and retainer guide 230 as well as the engagement of the plunger wings 450 with the retaining slots 950 and retaining fingers 980 ensures a desired orientation of the plunger 210 within the retainer guide 230 and prevents rotation of the plunger 210 within the retainer guide 230. As shown in FIGS. 1 and 15A-C, when assembled, the plunger 210 may be positioned within the retainer guide 230 at a desired height and orientation so that ramps 490 of the plunger 210 are aligned with archways 914 of the retainer guide 230, in order for a stinger conductor 120 to extend through the archways to engage the ramp 490.

The retainer guide 230 may be configured to be received in the receiving opening 180 cast or otherwise formed in the node housing 110 beneath the seizure mechanism 100. The bottom 182 of the opening 180 may be configured to prevent the closed end 960 of the retainer guide 230 from turning. This may be done by having the closed end 960 of the retainer guide 230 include flat portions 962 so that the closed end 960 is double-D shaped or obround or otherwise similarly shaped to correspond to a double-D shaped, obround, or similarly shaped bottom 182 so that the retainer guide 230 will not rotate within the opening 180 (FIG. 1). The circumference of the end 960 may be chamfered or have a protrusion 964 that is adapted for insertion within a corresponding recess 952 at the node opening bottom 182.

As shown in FIG. 1, the size and shape of the seizure mechanism 100 is configured so that when it is installed in the receiving hole 180 of the housing 110, the archway guide 914 of the retainer guide 230 is positioned relative to a penetration 160 in the node housing 110 to receive a stinger conductor 120 when a stinger 130 is installed in the housing. For example, the dimensions of the assembled seizure mechanism 100 can be tightly controlled due to the snap-fit assembly described above to provide a desired position of the plunger 210 and retainer guide 230. This allows the seizure mechanism 100 to appropriately sized to allow installation in the node housing 110 by simply dropping the mechanism 100 into the receiving hole 180 for the mechanism to be positioned for interaction with a stinger conductor 120 installed in the node housing 110. This reduces the likelihood of a misalignment and reduces the need for additional manual assembly and special tools to install and repair the mechanism 100. Adjustment of seizure depth is no longer required as the mechanism 100 provides a fixed stop point for installation and proper positioning of the plunger 210 and retainer guide 230 within the receiving hole 180.

The archway guides 914 help maintain the center conductor 120 in a straight condition, preventing the center conductor 120 from flexing and possibly shorting against the housing 110. A seizure lock nut 140 may be installed in an opening 180 opposite the seizure mechanism 100. In this example embodiment the seizure lock nut 140 is threadably installed in an upper portion of the receiving opening 180.

Figure 15A:
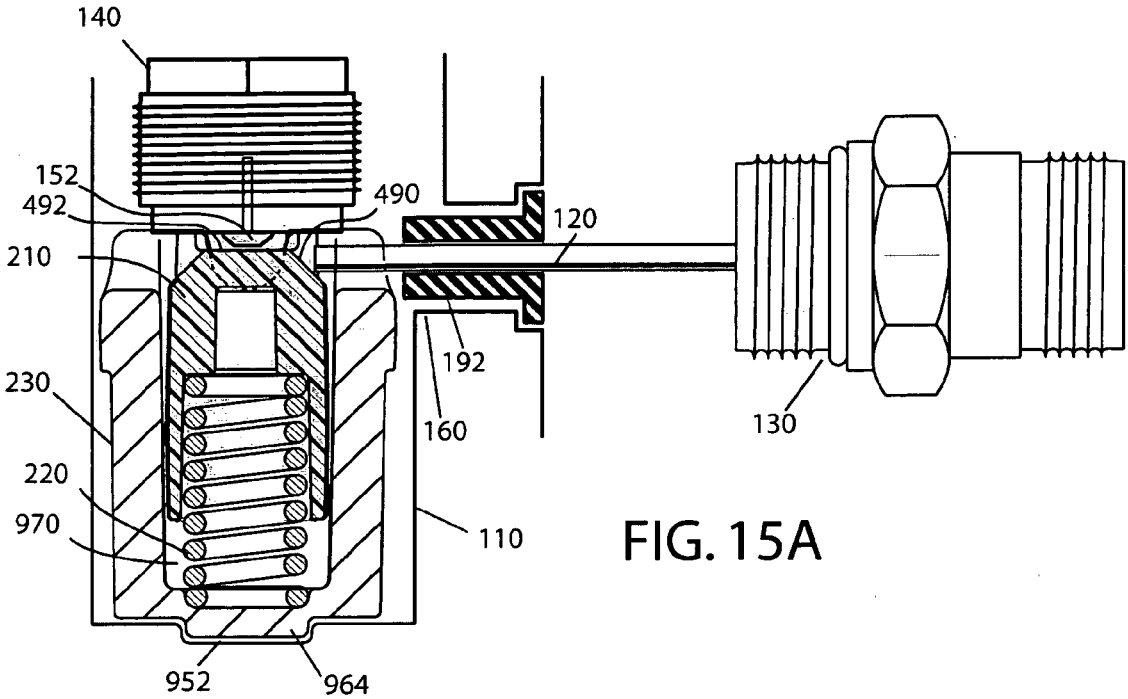
FIGS. 15A-15C illustrate an example of the interaction of a stinger conductor with a self-contained seizure conductor.
Figure 15B:
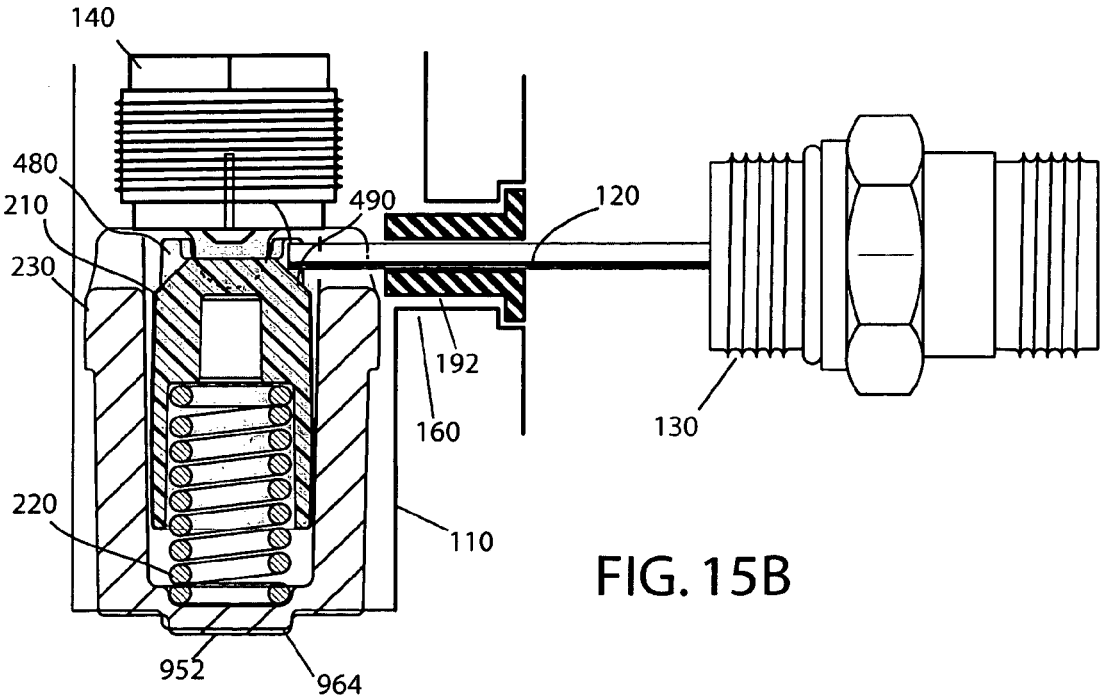
Figure 15C:
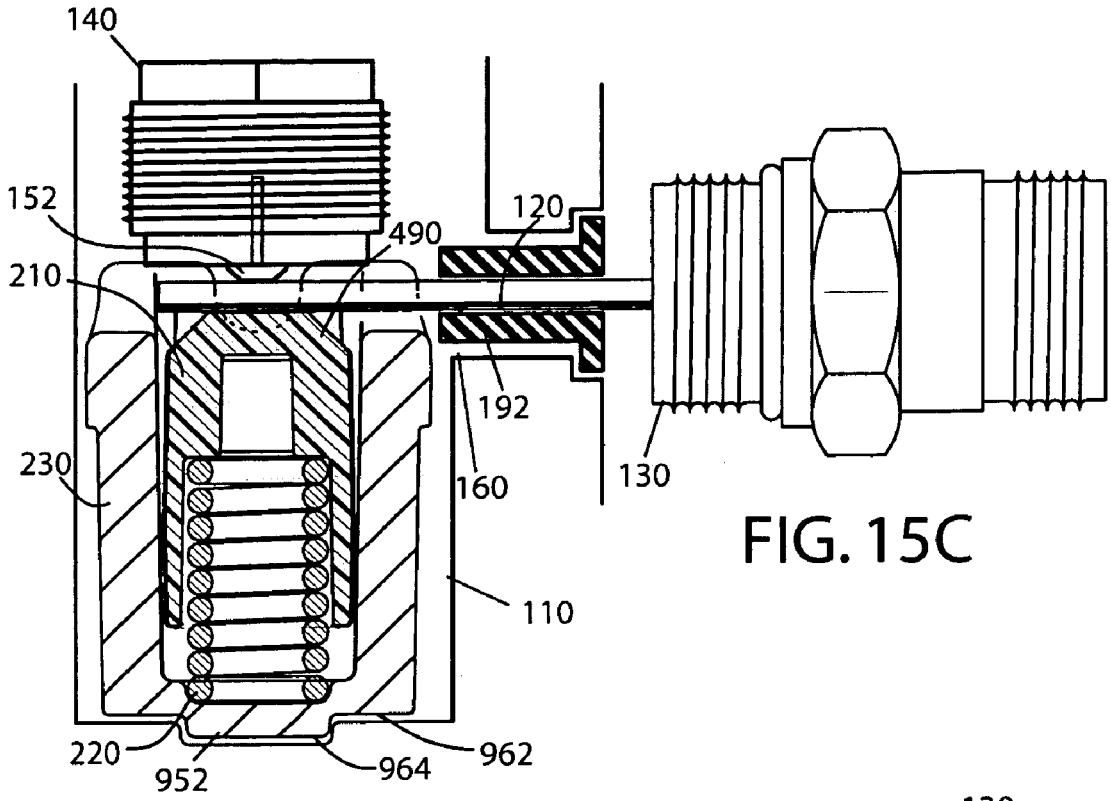
Figure 16:
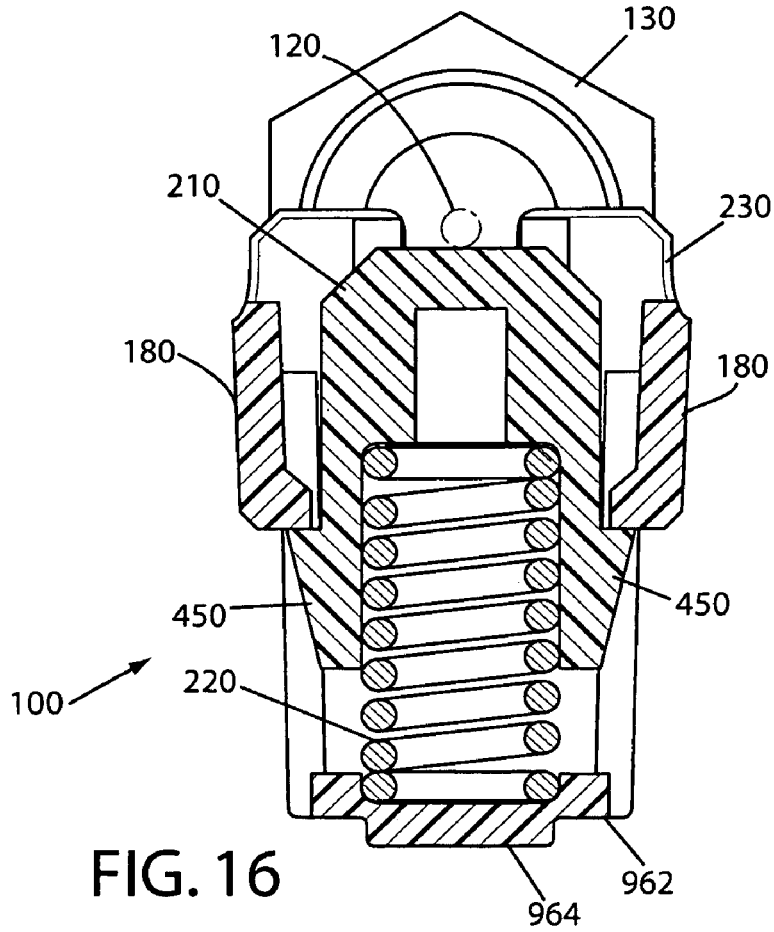
FIG. 16 shows a cutaway view along cut line 16-16 of FIG. 1.

As seen in FIG. 15A and FIG. 1, when the stinger 130 is installed into the node housing 110 and the center conductor 120 is installed in the bushing 150 in the penetration 160 of the node housing 110, the distal end of the center conductor may be passed through a guide 192 positioned and retained within the penetration 160 behind the bushing 150. The guide 192 may be configured to correspond with the narrow portion of the penetration 160. The stinger conductor 120 extends through an archway guide 914 facing the penetration and engages a ramp 490 of the plunger 210. As shown in FIG. 15B, the stinger conductor 120 may slide along the ramp 440 to the apex contacting portion 492 of the plunger 210. The engagement of the stinger conductor 120 with the plunger 210 forces the plunger 210 further downward into the retainer guide 230 further compressing the spring 220. The plunger 210 in turn, due to the pushing force of the spring 220, pushes against the stinger conductor 120 and, without significantly bending the stinger conductor 120, urges the conductor 120 into contact with the contact button 152 which is in electrical contact with a center pin 190. The center pin 190 may connect to a G connector of an amplifier (not shown), or some other device such as a device that uses an RF G connection, in the node housing 110. The distal ends of legs 480 may guide the stinger conductor 120 over the plunger 210.

When the stinger conductor 120 engages the crown 442 of the plunger 210, it pushes the plunger 210 down further into the retainer guide 230. The plunger 210 in turn, due to the pushing force of the spring, pushes against the stinger conductor 120 and without significantly bending the stinger center conductor 120, forces or urges the stinger conductor 120 into contact with a the nail head 152 of the seizure lock nut 140.

The internal seizure mechanism 100 provides a spring, a guide, and a plunger that may be snap-fit together into a self-contained assembly that may be installed in a node housing by simply dropping it into a receiving hole. The mechanism reduces the likelihood of a misalignment and reduces the need for additional manual assembly and special tools for installation and/or repair. Adjustment of the seizure depth is not required as the assembly provides a fixed stop point for installation. The mechanism does not require additional inspection at the manufacturing facility.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

What is claimed is:

1. An apparatus comprising: a retainer guide having a receiving slot, and a guide way configured to receive a stinger conductor; a plunger movably retained within the retainer guide, the plunger having a protrusion configured to engage the receiving slot of the retainer guide;

and a spring within the retainer guide pushing the plunger in a direction outward of the retainer guide.

2. The apparatus of claim 1, wherein the plunger is moveable between a first position suitable for engaging a distal end of a stinger conductor inserted through the guide way of the retainer guide and a second recessed position within the retainer guide.

3. The apparatus of claim 1, wherein the guide way comprises an archway in a sidewall of the retainer guide.

4. The apparatus of claim 1, wherein a ramp at an end of the plunger is aligned with the guide way to engage the distal end of the stinger conductor inserted through the guide way.

5. The apparatus of claim 1, wherein the retainer guide and the plunger are snap fit together.

6. The apparatus of claim 1, wherein the retainer guide is sized to fit in a receiving hole in a node housing with the guide way of the retainer guide positioned to receive a stinger conductor inserted through a penetration in the node housing.

7. The apparatus of claim 1, wherein the plunger is positioned within the retainer guide so that when the retainer guide is dropped in a receiving hole in a node housing the plunger is positioned to engage the distal end of a stinger conductor inserted through a penetration in the node housing.

8. The apparatus of claim 1, wherein the slot and the protrusion are configured to prevent expulsion of the plunger from the retainer guide.

9. The apparatus of claim 1, wherein the plunger is self-orienting within the retainer guide.

10. The apparatus of claim 1, wherein an interior receiving area of the retainer guide is obround and a body of the plunger is obround.

11. The apparatus of claim 1, further comprising a retaining finger configured to engage the protrusion of the plunger.

12. The apparatus of claim 11, wherein the retaining finger is configured to allow insertion of the protrusion within the retaining slot to prevent removal of the protrusion from the retaining slot.

13. A method comprising;

dropping a self-contained seizure mechanism into a receiving hole of a node housing, the self-contained seizure mechanism comprising:

a retainer guide, the retainer guide having a housing with an open end and a guide way configured to receive a stinger conductor therethrough;

a plunger movably secured within the retainer guide;

a spring within the retainer guide configured to push the plunger in an outward direction of the retainer guide; and retaining means for movably securing the plunger to the retainer guide to allow movement of the plunger between a first position suitable for engaging a distal end of a stinger conductor inserted through the guide way of the retainer guide, and a second recessed position within the retainer guide.

14. The method of claim 13, further comprising installing a stinger into a penetration in the node housing so a distal end of the stinger conductor of the stinger extends through the guide way and engages the plunger.

15. The method of claim 14, further comprising forcing the plunger upward within the retainer guide against the stinger conductor to force the stinger conductor into contact with a conductor button of a seizure locknut by the plunger.

16. A method of assembling an internal seizure mechanism comprising: inserting a spring into a retainer guide, the retainer guide having an open end and a closed end having an end wall; inserting a plunger through the open end of a retainer guide, the plunger having an open end and a closed end so that the spring abuts the closed end wall of the retainer guide and the closed end of the plunger; engaging a protrusion on the plunger with a receiving slot of the retainer guide; and movably retaining the plunger within the retainer guide.

17. The method of claim 16, further comprising: further inserting the plunger within the retainer guide so that the protrusion on the plunger extends past a retaining finger on the retainer guide.

18. The method of claim 17, further comprising abutting an abutting surface of the retaining finger against an abutting surface of the protrusion to retain the plunger within the retainer guide in an initial position.

* * * * *